US005394224A

United States Patent [19]

Irobe

[11] Patent Number: 5,394,224

[45] Date of Patent: Feb. 28, 1995

[54] IMAGE FORMING APPARATUS HAVING AN ELECTRICALLY CONDUCTIVE MEMBER FOR WIPING A LIGHT TRANSMITTING BELT-LIKE PHOTOSENSITIVE BODY

[75] Inventor: Kou Irobe, Kanagawa, Japan

[73] Assignee: Fuji Xerox Co., Ltd., Tokyo, Japan

[21] Appl. No.: 84,980

[22] Filed: Jul. 2, 1993

[30] Foreign Application Priority Data

Jul. 3, 1992 [JP] Japan ..... 4-176448

[51] Int. Cl.[6] ..... G03G 15/02

[52] U.S. Cl. ..... 355/219; 361/221; 355/299; 355/300; 355/301

[58] Field of Search ..... 355/212, 219, 296–301; 361/221; 15/256.5, 256.51, 256.52; 118/652

[56] References Cited

U.S. PATENT DOCUMENTS

| | | | |
|---|---|---|---|
| 4,506,973 | 3/1985 | Ernst . | |
| 4,693,592 | 9/1987 | Kurpan . | |
| 4,853,741 | 8/1989 | Ku | 355/300 |
| 4,903,083 | 2/1990 | Bothner | 355/300 |

FOREIGN PATENT DOCUMENTS

| | | |
|---|---|---|
| 60-98857 | 7/1985 | Japan . |
| 60-98858 | 7/1985 | Japan . |
| 60-144780 | 7/1985 | Japan . |
| 60-144781 | 7/1985 | Japan . |

OTHER PUBLICATIONS

*Patent Abstracts of Japan*, vol. 7, No. 130, (P202) Published Jun. 7, 1983 for Doc. 58–46372.

*Primary Examiner*—R. L. Moses

*Attorney, Agent, or Firm*—Finnegan, Henderson, Farabow, Garrett & Dunner

[57] ABSTRACT

An image forming apparatus such as an electrophotographic copying machine uses a driven light-transmitting endless belt-like photosensitive body (belt). A charging unit charges the belt and a latent image is then formed on a front side of the belt. Thereafter, a toner image is developed on the belt for transfer to a sheet. Discharge and image erasing are provided on the back side of the belt. An electrically conductive wiping member contacts the back surface of the belt to clean contaminant therefrom.

8 Claims, 8 Drawing Sheets

IMAGE FORMING APPARATUS HAVING AN ELECTRICALLY CONDUCTIVE MEMBER FOR WIPING A LIGHT TRANSMITTING BELT-LIKE PHOTOSENSITIVE BODY

BACKGROUND OF THE INVENTION

1. Field of the Invention

The invention relates to image forming apparatuses such as electrophotographic copying machines. More particularly, the invention is directed to an image forming apparatus such as an electrophotographic copying machine that employs an endless belt-like, thin plate-like light-transmitting photosensitive body and discharges the photosensitive body and/or forms screen patterns for photographic reproduction by irradiating a beam from the back surface of the photosensitive body.

2. Related Art

The above-described image forming apparatus performs the operation of discharging the photosensitive body and/or erasing unnecessary images and/or forming screen patterns for improving photographic reproducibility (or tone) by irradiating a beam from the back surface of the photosensitive body while utilizing the light-transmitting property of the material of which the photosensitive body is made.

FIG. 15 shows a schematic construction of the above-described image forming apparatus. In FIG. 15, reference numeral 1 designates an endless belt-like photosensitive body installed onto a drive roll 2 and driven rolls 3, 4. Arranged on the front surface of this photosensitive body 1 are, from the upstream side in the direction of moving the photosensitive body 1, a charging unit 5 for charging the photosensitive body 1; an image exposing irradiating section 6 for forming a latent image by irradiating an image exposing beam 6*a* onto the front surface of the photosensitive body 1; a developing unit 7 for developing a toner image from the latent image; a transfer unit 9 for transferring the toner image onto a sheet fed by a sheet feeding means 8; a separating unit 10 for separating the sheet having the toner image transferred thereon from the photosensitive body 1, and a cleaning unit 11. Reference numeral 11*a* designates a sheet forwarding means for forwarding the sheet separated by the separating unit 10 to a fixing unit 12. Reference numerals 28*a*, 28*b*, 28*c* designate other rolls or bars.

The photosensitive body 1 is made of a light-transmitting photosensitive material. On the back surface of the photosensitive body 1 are two units: a discharging unit 13 for discharging the photosensitive body 1 by irradiating a beam onto the back surface of the photosensitive body as well as the upstream sides of the charging unit 5 and the transfer unit 9; and an unnecessary image erasing unit and/or screen pattern forming unit 14 positioned on the downstream side of the image exposing irradiating section 6.

When the back surface of the photosensitive body 1 of the thus constructed image forming apparatus becomes dirty, the beam from the discharging unit 13 and the unnecessary image erasing unit and/or screen pattern forming unit 14 irradiated from the back surface of the photosensitive body 1 is blocked by the dirt, thereby decreasing the amount of light reaching a charge generating layer stacked on the front surface of the base material of the photosensitive body 1 and causing various inconveniences.

The back surface of the photosensitive body 1 must therefore be cleaned by some means in the above-described image forming apparatus such as an electrophotographic copying machine.

Conventional cleaning members are disclosed in Unexamined Japanese Patent Application (OPI) Nos. Sho. 60-144780, Sho. 60-144781 and Unexamined Japanese Utility Model Applications Nos. Sho. 60-98857 and Sho. 60-98858.

The following problems have been encountered by these conventional cleaning members. The potential generated on the back surface of the photosensitive body is increased by triboelectricity or the like. This attracts the developer, paper powder, dust or the like more strongly to the back surface of the photosensitive body, and therefore may sometimes make mechanical cleaning insufficient. On the other hand, only the discharging of the back surface of the photosensitive body is not adequate to prevent adhesion of the developer, paper powder, dust or the like to the back surface of the photosensitive body.

SUMMARY OF THE INVENTION

The invention has been made in view of the above circumstances. Accordingly, the object of the invention is to provide an image forming apparatus such as an electrophotographic copying machine that discharges the back surface of the photosensitive body and/or erases unnecessary images and/or forms screen patterns for photographic reproduction by irradiating a beam from the back surface of the photosensitive body, having such a feature of preventing disturbances on images due to inconsistent discharging and/or defective unnecessary image erasing and/or improper formation of screen patterns for photographic reproduction caused by the adhesion of the developer, paper powder, dust or the like to the back surface of the photosensitive body.

The above and other objects can be achieved by a provision of an image forming maching such as an electrophotographic copying machine which, according to the present invention, includes a light-transmitting endless belt-like photosensitive body and discharges the photosensitive body and/or erases unnecessary images and/or forms screen patterns for photographic reproduction by irradiating a beam from the back surface of the photosensitive body. In such an image forming apparatus, an electrically conductive wiping member is arranged inside the photosensitive body so that the wiping member is in frictional contact with the back surface of the photosensitive body.

The wiping member is grounded and connected to a power source.

A plurality of wiping members are provided, and the polarity of at least one of the wiping members is opposite to those of the other wiping members or connected to an ac power source.

The wiping member is rotated at a predetermined cycle so that a surface on which the wiping member comes in contact with the back surface of the photosensitive body is updated.

At least a part of the wiping member not in contact with the back surface of the photosensitive body is covered.

The wiping member is brought into contact with the back surface of the photosensitive body when the photosensitive body is being rotated and is not forming an image.

The back surface of the photosensitive body is cleaned by wiping by the wiping member. Triboelectricity generated by friction between the photosensitive body and the wiping member is either controlled by the electrically conductive wiping member or grounded by such wiping member. A voltage applied to the wiping member can cancel triboelectricities.

DESCRIPTION OF THE PREFERRED EMBODIMENTS

Figure 1:
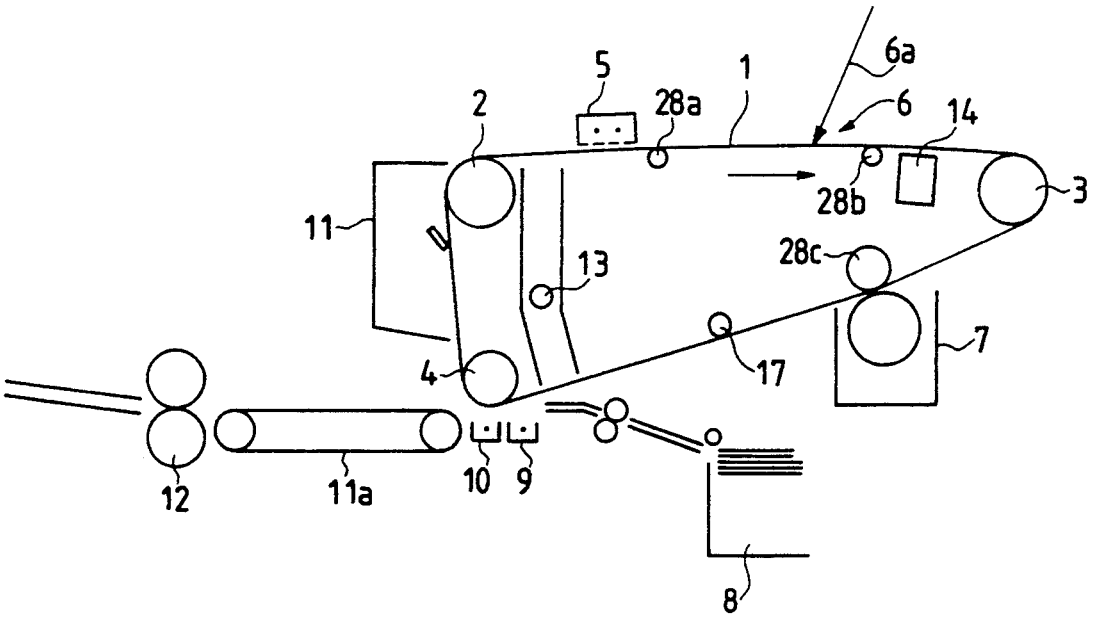
FIG. 1 is a schematic diagram illustrative of a main portion of a first embodiment of the invention.
Figure 2:
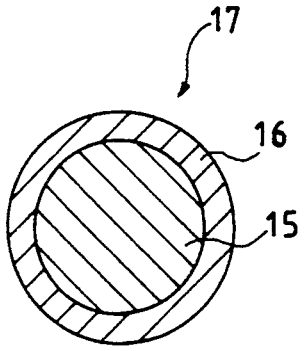
FIG. 2 is an enlarged sectional view of a cleaning member.
Figure 3:
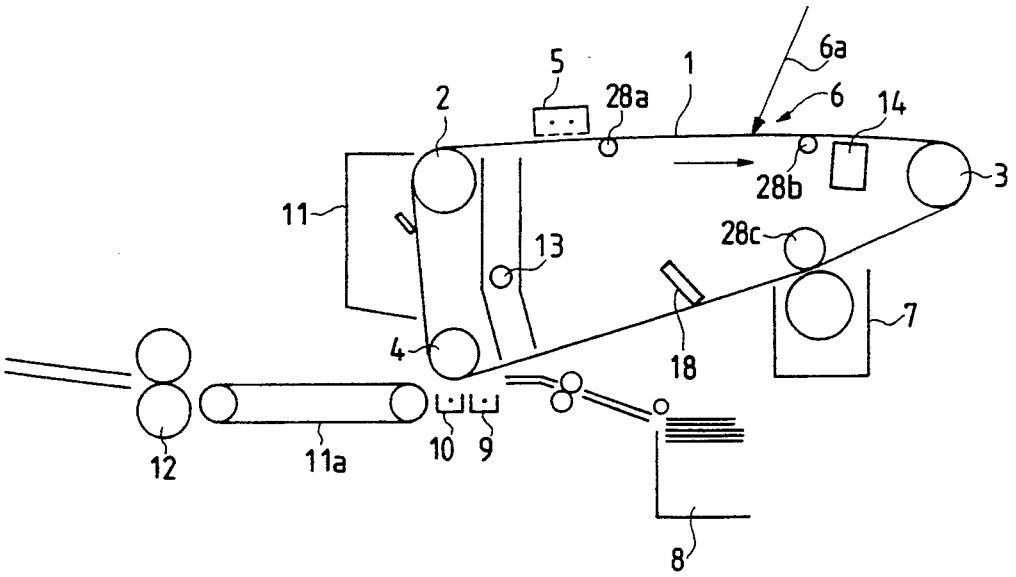
FIG. 3 is a schematic diagram illustrative of a modified example of the first embodiment of the invention.

Embodiments of the invention will be described with reference to FIGS. 1 to 14. In these embodiments, the same parts and components as those of a conventional example shown in FIG. 15 are designated by the same reference numerals.

FIG. 1 shows a first embodiment of the invention. On the back surface of an endless belt-like photosensitive body 1 is a cleaning member 17 formed of a metal-made core member 15 and an electrically conductive felt member 16. The cleaning member 17 is put in contact with the back surface of the photosensitive body 1 at a predetermined contact pressure. The cleaning member 17 is firmly secured to a frame (not shown) and arranged so as to be in irrotational frictional contact with the back surface of the photosensitive body 1.

As a result of the above construction, contaminants such as the developer, paper powder, dust or the like which have adhered to the back surface of the photosensitive body 1 can be wiped off by the cleaning member 17. Since the felt member 16 serving as the wiper is electrically conductive, increases in the potential of the back surface of the photosensitive body 1 due to triboelectric effect with the cleaning member 17 can be suppressed.

The position at which the cleaning member 17 is arranged is not limited to the one shown in FIG. 1 in the first embodiment. A plurality of cleaning members may also be arranged.

Figure 4:
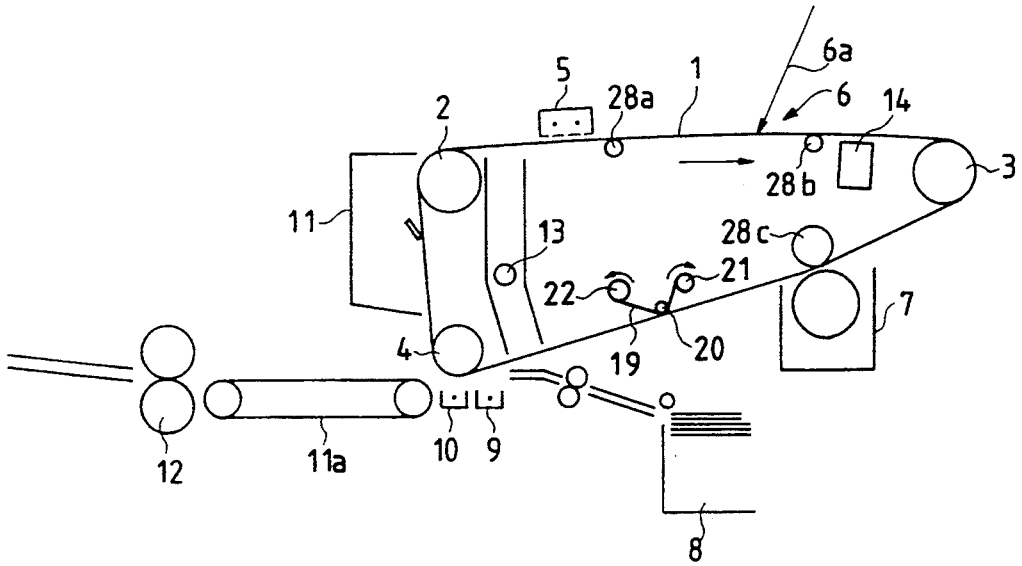
FIG. 4 is a schematic diagram illustrative of another modified example of the first embodiment of the invention.

In addition to the above-described example, a blade 18 made of an electrically conductive rubber member may be put in frictional contact with the back surface of the photosensitive body 1, or as shown in FIG. 4, an electrically conductive web 19 wound on rolls 21, 22 may be biased onto the back surface of the photosensitive body 1 by the roll 20.

Figure 5:
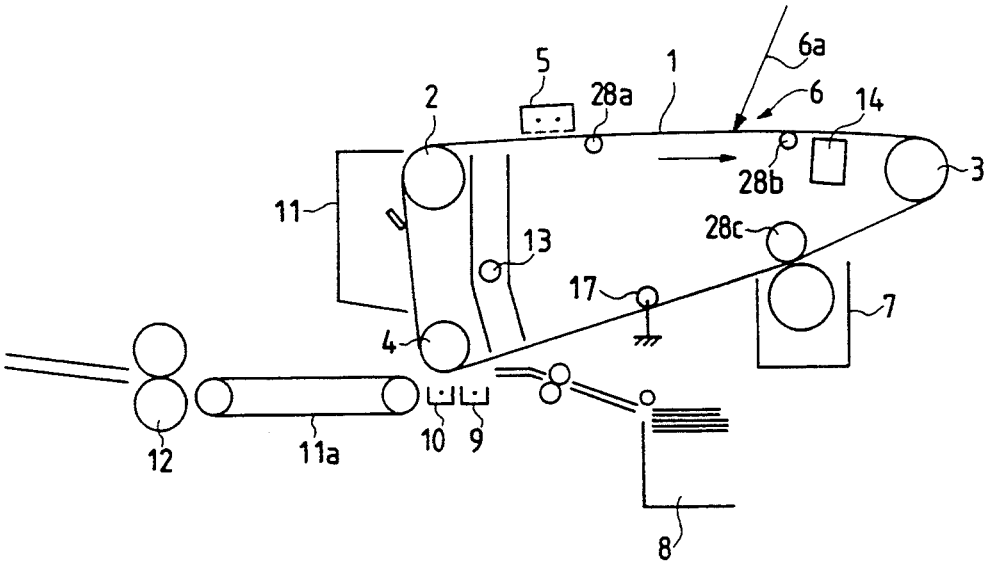
FIG. 5 is a schematic diagram illustrative of a main portion of a second embodiment of the invention.

FIG. 5 shows a second embodiment of the invention. The cleaning member 17 that is in frictional contact with the back surface of the photosensitive body 1 is grounded through a member such as a mechanical frame supporting the cleaning member 17.

Accordingly, not only the particles contaminating the back surface of the photosensitive body 1 can be wiped off by the cleaning member 17, but also the charges stored on the back surface can be removed.

Figure 6:
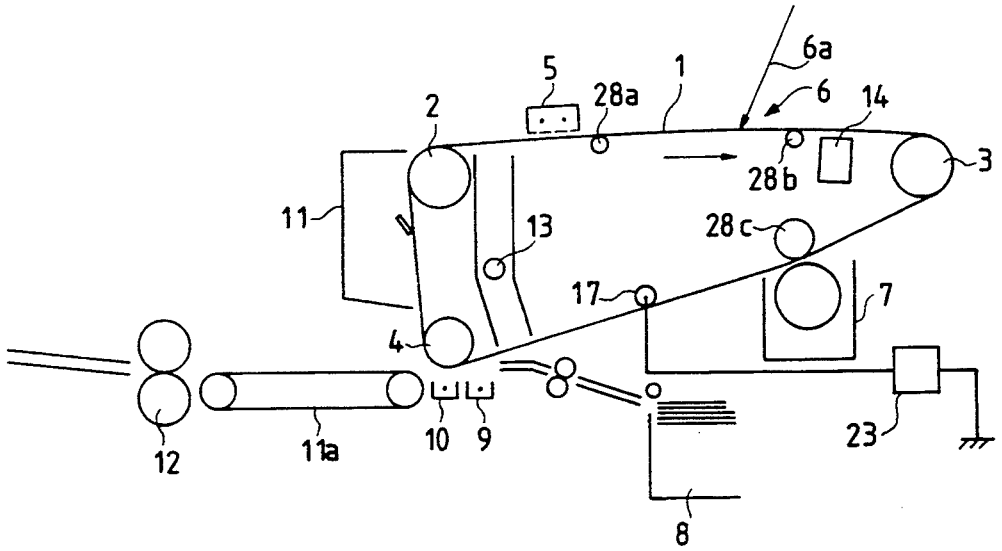
FIG. 6 is a schematic diagram illustrative of a modified example of the second embodiment of the invention.

The cleaning member 17 may be connected to a power source 23 as shown in FIG. 6. For the purpose of discharging the back surface of the photosensitive body 1, the power source 23 is preferred to be an ac power source or a dc power source that is an opposite polarity of the charges stored on the back surface of the photosensitive body 1. However, for the purpose of attracting the contaminants such as the developer, paper powder, dust or the like to the cleaning member 17, the power source 23 may be of the same polarity as that of the back surface of the photosensitive body 1.

Figure 7:
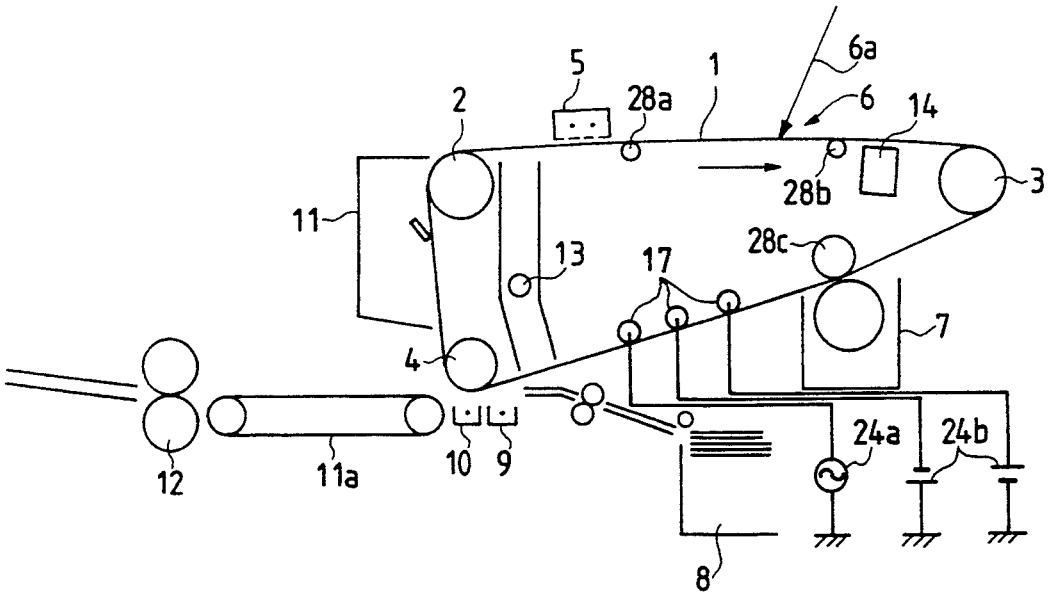
FIG. 7 is a schematic diagram illustrative of a main portion of a third embodiment of the invention.

FIG. 7 shows a third embodiment of the invention. A plurality of cleaning member 17 made of an electrically conductive material are arranged so as to be in contact with the back surface of the photosensitive body 1, and one of these cleaning members 17 is connected to an ac power source 24*a* and at least another cleaning member 17 is connected to a dc power source 24*b* that is of an opposite polarity of the power source 24*a*.

Accordingly, the back surface of the photosensitive body 1 can be discharged, and the positively or negatively charged developer, paper powder, dust or the like which have adhered to the back surface of the photosensitive body 1 can be removed.

Figure 8:
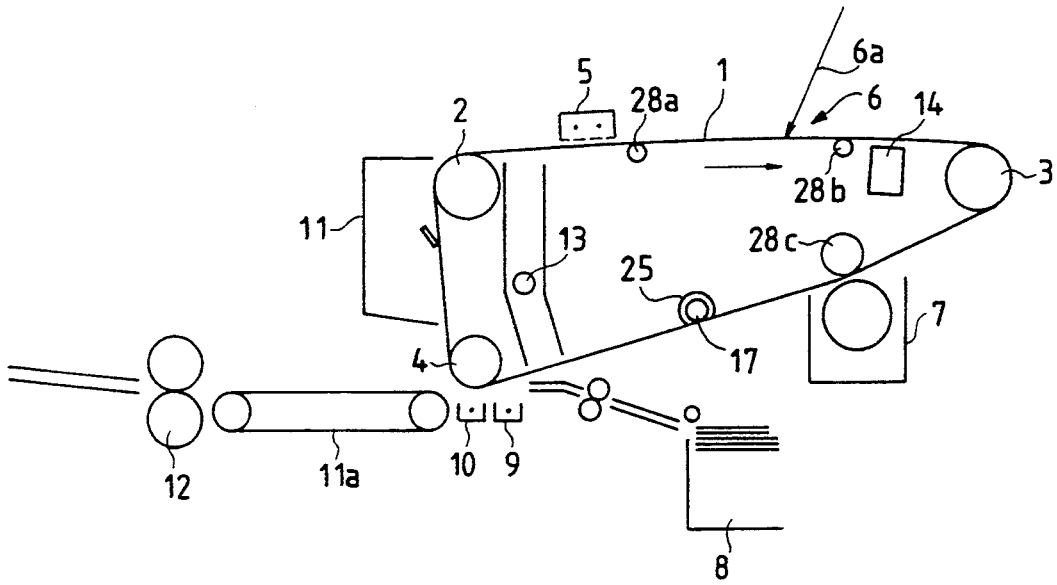
FIG. 8 is a schematic diagram illustrative of a main portion of a fourth embodiment of the invention.
Figure 9:
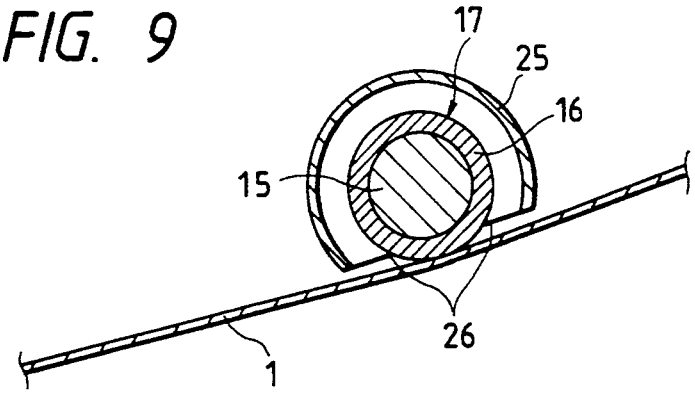
FIG. 9 is an enlarged sectional view of the main portion shown in FIG. 8.

FIGS. 8 and 9 show a fourth embodiment of the invention. At least a part of the cleaning member 17, which part is not in contact with the photosensitive body 1, is provided with a cover 25, the cleaning member 17 being made of an electrically conductive material and arranged inside the photosensitive body 1. This prevents the developer, paper powder, dust or the like from adhering to such a part of the cleaning member as has not yet been used. Reference numeral 26 designates a seal.

Although the cleaning member 17 is fixed in its rotation position when it is brought into irrotational cleaning contact with the back surface of the photosensitive body 1, the contacting surface portion of the cleaning member 17 is periodically changed by changing the fixed rotative position of the cleaning member.

Figure 10:
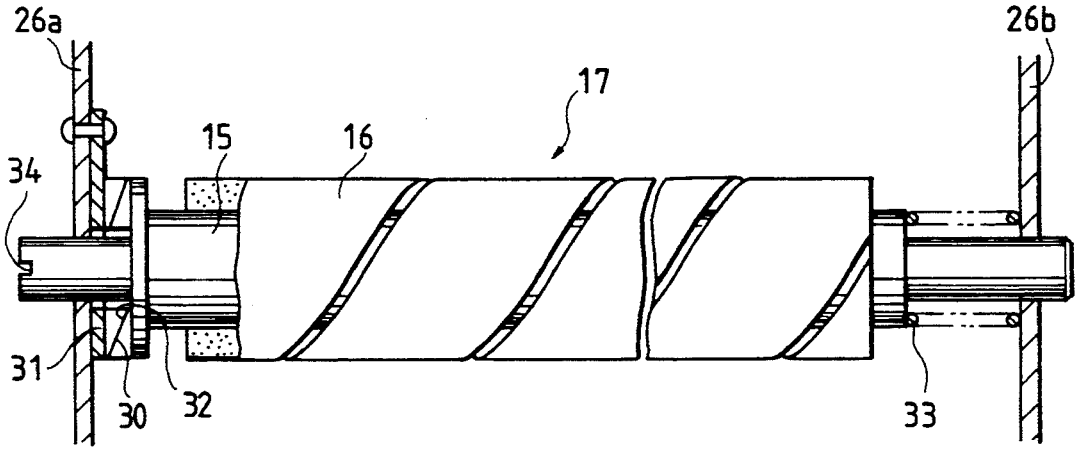
FIG. 10 is a partially cutaway front view showing an exemplary structure for supporting the cleaning member.
Figure 11:
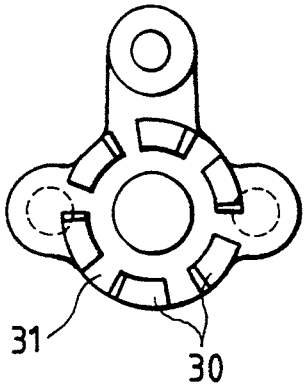
FIG. 11 is a front view showing a pawl member.

FIGS. 10 and 11 show an exemplary construction by which periodic repositioning of the cleaning member 17 can change the member surface portion used for cleaning by rotating the cleaning surface in a single direction by a predetermined angle relative to the back surface of the photosensitive body 1.

Both ends of the core member 15 of the cleaning member 17 are supported by front and rear frame members 26*a*, 26*b*, respectively, so as to be rotatable and axially movable. Inside the frame member 26*a* that is on the front side is a pawl member 31 firmly secured. The pawl member 31 has indentations 30 extending in the direction of rotation on the inner side thereof. The end of the core member 15 of the cleaning member 17 is a pawl 32 that is engageable with the indentations 30 of the pawl 31. The cleaning member 17 is biased onto the pawl member 31 by a spring 33.

According to this construction, the cleaning member 17 is engaged with the pawl member 31 in the rotational direction by the biasing of the spring, and the felt member 16 spirally wrapped around the circumference of the cleaning member cleans the back surface of the photosensitive body 1 continuously in irrotational frictional contact.

When the contact surface of the cleaning member 17 gets deteriorated as the cleaning operation has been performed for a predetermined period of time, the cleaning member 17 is rotated in one direction by one pawl while moving the cleaning member 17 in the axial direction against the spring 33 and disengaging the indentations 30 of the pawl member 31 from the pawl 32. As a result, the cleaning surface is updated, allowing the cleaning operation to be performed for a predetermined period of time.

The cleaning member 17 is rotated by fitting a tool such as a screwdriver into a screwdriver groove 34 arranged at the end on the front side of the core member 15 and pushing the core member 15 against the biasing force of the spring 33.

Figure 12A:
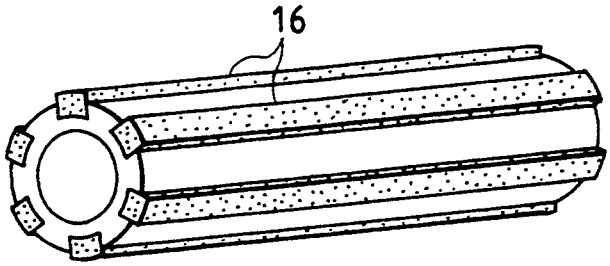
FIGS. 12 (*a*) and (*b*) are perspective views showing different structures for mounting a felt member.
Figure 12B:
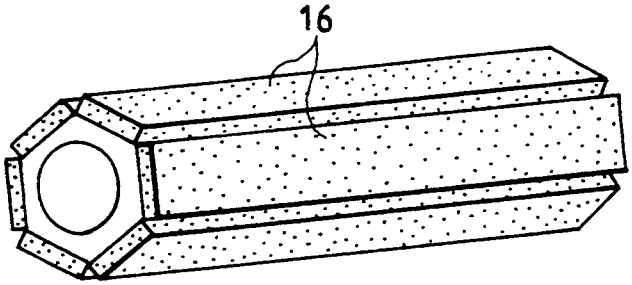

While the example in which the electrically conductive felt member 16 is wrapped has been described in the embodiment shown in FIG. 10, the felt member 16 may be embedded radially into the circumference of a core member 15*a* or bonded polygonally as shown in FIGS. 12 (*a*) and (*b*). In this case, the interval at which the felt member pieces 16 are circumferentially arranged must coincide with the angle at which the cleaning member 17 is rotated by the pawl member.

Figure 13:
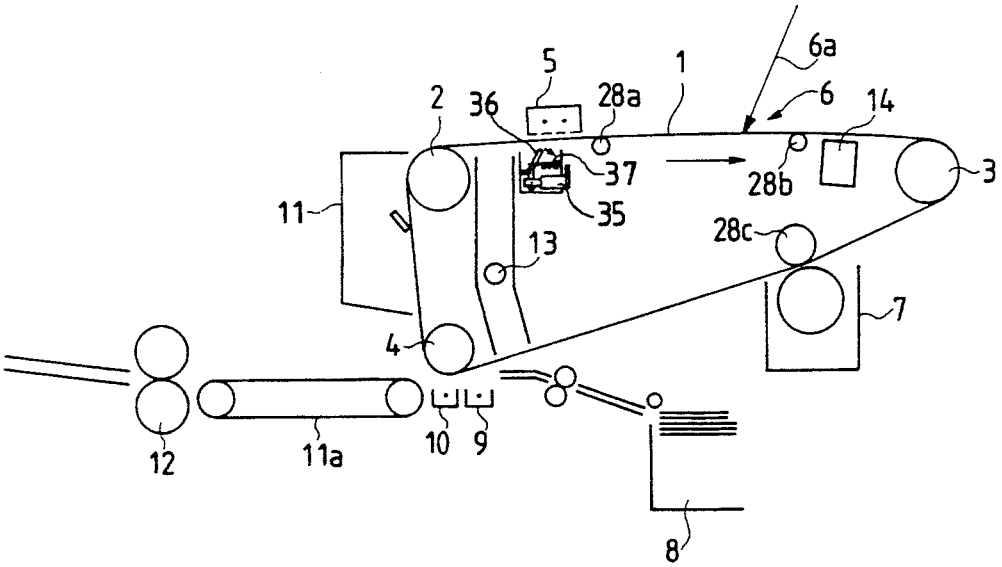
FIG. 13 is a schematic diagram illustrative of a main portion of a fifth embodiment of the invention.

FIG. 13 shows a fifth embodiment of the invention. A cleaning member 36 made of a blade is attached to or detached from the back surface of the photosensitive body 1 by a solenoid 35 arranged inside the photosensitive body 1. The solenoid 35 operates against a spring 37 in synchronism with the timing of forming an image, so that the cleaning member 36 comes in contact with the back surface of the photosensitive body 1 only when no image is being formed.

Therefore, a change in the gap between the photosensitive body 1 and the image forming unit due to the contact of the cleaning member 36 imposes no problem as long as such gap does not become zero. Rather, a large bite of the cleaning member 36 facilitates the removal of the developer, paper powder, dust or the like having adhered to the back surface of the photosensitive body 1.

A plurality of cleaning members 36 may be arranged in this embodiment. The position of the cleaning member 36 is not limited to the one shown in FIG. 1.

Figure 14:
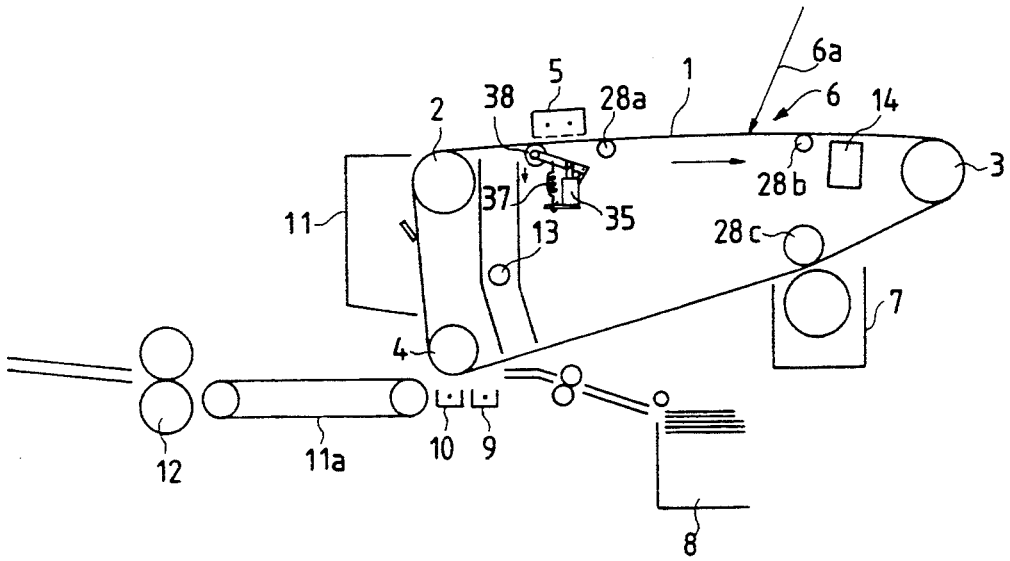
FIG. 14 is a schematic diagram illustrative of a main portion of a modified example of the fifth embodiment of the invention.
Figure 15:
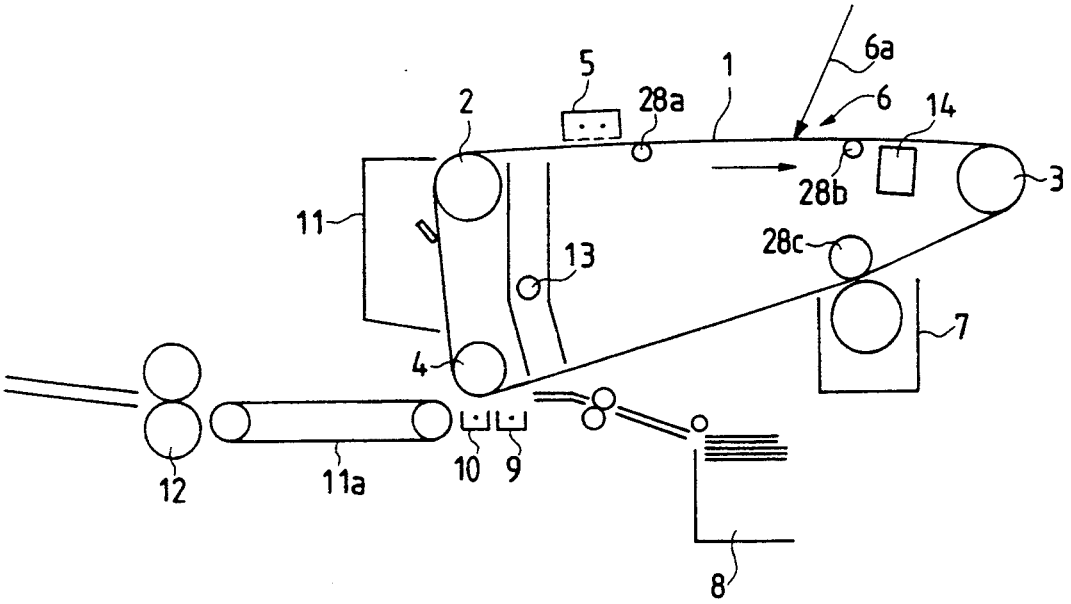
FIG. 15 is a schematic diagram illustrative of a conventional image forming apparatus.

FIG. 14 shows a modified example of the fifth embodiment. Arranged is a cleaning member 38 that is made of a felt roll whose bite into the photosensitive body 1 is varied by the solenoid 35 arranged inside the photosensitive body 1. It is difficult to completely remove the developer, paper powder, dust or the like having adhered to the back surface of the photosensitive body with a bite that is not affected by changes in the gap between the photosensitive body 1 and the image forming unit due to the presence or absence of the cleaning member 38. Therefore, it is a large bite of the cleaning member at the time the photosensitive body 1 is being rotated and at the time no image is being formed that can remove the contaminants of the back surface of the photosensitive body which have not been removed by the conventional bite.

According to the invention, the back surface of the photosensitive body 1 is cleaned through frictional contact while discharged by the wiping member such as the electrically conductive felt 16, so that the developer, paper powder, dust or the like having adhered to the back surface of the photosensitive body 1 can be cleaned sufficiently.

Therefore, the invention can prevents disturbances on images caused by inconsistent discharging of the back surface of the photosensitive body 1 due to adhesion of the developer, paper powder, dust or the like, and/or defective erasing of unnecessary images, and/or improper formation of screen patterns for photographic reproduction.

What is claimed is:

1. An image forming apparatus having a charging unit for charging a front surface of a photosensitive unit on which a latent image may be formed by irradiation after charging once a transferrable toner image may thereafter be developed, and further having a discharging unit for discharging the photosensitive unit and another unit for erasing unnecessary images and/or forming screen patterns for photographic reproduction by irradiating a beam from a back surface of the photosensitive body, a light-transmitting endless belt-like photosensitive body forming the photosensitive unit having charging and irradiation performed on a front surface thereof; and the apparatus comprising:

an electrically conductive wiping member arranged inside the photosensitive body so that the wiping member comes in frictional contact with the back surface of the photosensitive body.

2. An image forming apparatus according to claim 1, wherein the wiping member is grounded.

3. An image forming apparatus such as an electrophotographic copying machine according to claim 1, wherein the wiping member is connected to a power source.

4. An image forming apparatus such as an electrophotographic copying machine according to claim 1, wherein a plurality of wiping members are provided and the polarity of at least one of the wiping members is opposite to those of the other wiping members.

5. An image forming apparatus such as an electrophotographic copying machine according to claim 1, wherein a plurality of wiping members are provided and at least one of the wiping members is connected to an ac power source.

6. An image forming apparatus according to claim 1, wherein the wiping member is supported in a fixed rotational position during wiping operation of the back surface of the photosensitive body, and further is periodically moved rotatively at a predetermined cycle so that a wiping surface of the wiping member that comes in contact with the back surface of the photosensitive body is periodically changed.

7. An image forming apparatus according to claims 1 to 6, wherein at least a part of the wiping member not in contact with the back surface of the photosensitive body is covered.

8. An image forming apparatus according to claim 1, wherein the wiping member is brought into contact with the back surface of the photosensitive body when the photosensitive body is being rotated and is not forming an image.

* * * * *